US012480271B2

(12) United States Patent
Wiedenmann

(10) Patent No.: US 12,480,271 B2
(45) Date of Patent: Nov. 25, 2025

(54) HANDLING DEVICE AND METHOD FOR GRIPPING AND INSERTING A PILE TUBE INTO A BOREHOLE

(71) Applicant: BAUER Offshore Technologies GmbH, Schrobenhausen (DE)

(72) Inventor: Ulli Wiedenmann, Schrobenhausen (DE)

(73) Assignee: BAUER Offshore Technologies GmbH, Schrobenhausen (DE)

( * ) Notice: Subject to any disclaimer, the term of this patent is extended or adjusted under 35 U.S.C. 154(b) by 217 days.

(21) Appl. No.: 18/458,792

(22) Filed: Aug. 30, 2023

(65) Prior Publication Data

US 2024/0093455 A1 Mar. 21, 2024

(30) Foreign Application Priority Data

Sep. 16, 2022 (EP) ..... 22196152

(51) Int. Cl.
*E02D 7/28* (2006.01)
*E02D 5/38* (2006.01)
*E02D 5/66* (2006.01)

(52) U.S. Cl.
CPC ..... *E02D 7/28* (2013.01); *E02D 5/38* (2013.01); *E02D 5/665* (2013.01); *E02D 2250/0007* (2013.01); *E02D 2250/0023* (2013.01)

(58) Field of Classification Search
CPC .. E02D 7/28; E02D 5/38; E02D 5/665; E02D 2250/007; E02D 2250/0023
See application file for complete search history.

(56) References Cited

U.S. PATENT DOCUMENTS

| | | | |
|---|---|---|---|
| 4,235,469 | A | 11/1980 | Denny et al. |
| 2010/0296875 | A1 | 11/2010 | Thomson |

FOREIGN PATENT DOCUMENTS

| | | | |
|---|---|---|---|
| EP | 2 930 275 | A1 | 10/2015 |
| EP | 3 754 115 | A1 | 12/2020 |
| JP | 2002-097639 | A | 4/2002 |
| JP | 2002-194739 | A | 7/2002 |
| JP | 2017-089327 | A | 5/2017 |
| KR | 10-2021-0106342 | A | 8/2021 |
| WO | 2007/028794 | A2 | 3/2007 |
| WO | 2012/076874 | A2 | 6/2012 |
| WO | 2021/180515 | A1 | 9/2021 |

OTHER PUBLICATIONS

The extended European search report issued by the European Patent Office on Mar. 7, 2023, which corresponds to European Patent Application No. EP 22196152.7-1005.
An Office Action mailed by the Japanese Patent Office on Jan. 9, 2024, which corresponds to Japanese Patent Application No. 2023-148285 and is related to U.S. Appl. No. 18/458,792.

*Primary Examiner* — Kyle Armstrong
(74) *Attorney, Agent, or Firm* — Studebaker Brackett PLLC

(57) ABSTRACT

The invention relates to a handling device for gripping and inserting a pile tube into a borehole in the ground to form a foundation pile, comprising a base frame, a gripping device for gripping and holding the pile tube, and a holding element for releasably connecting the base frame to a hoist, in particular a suspension rope. According to the invention, it is provided that at least one inlet device for supplying a curable medium is arranged on the base frame in an upper region and at least one outlet device for the curable medium to the pile tube is arranged in a lower region.

14 Claims, 4 Drawing Sheets

Figure 1:
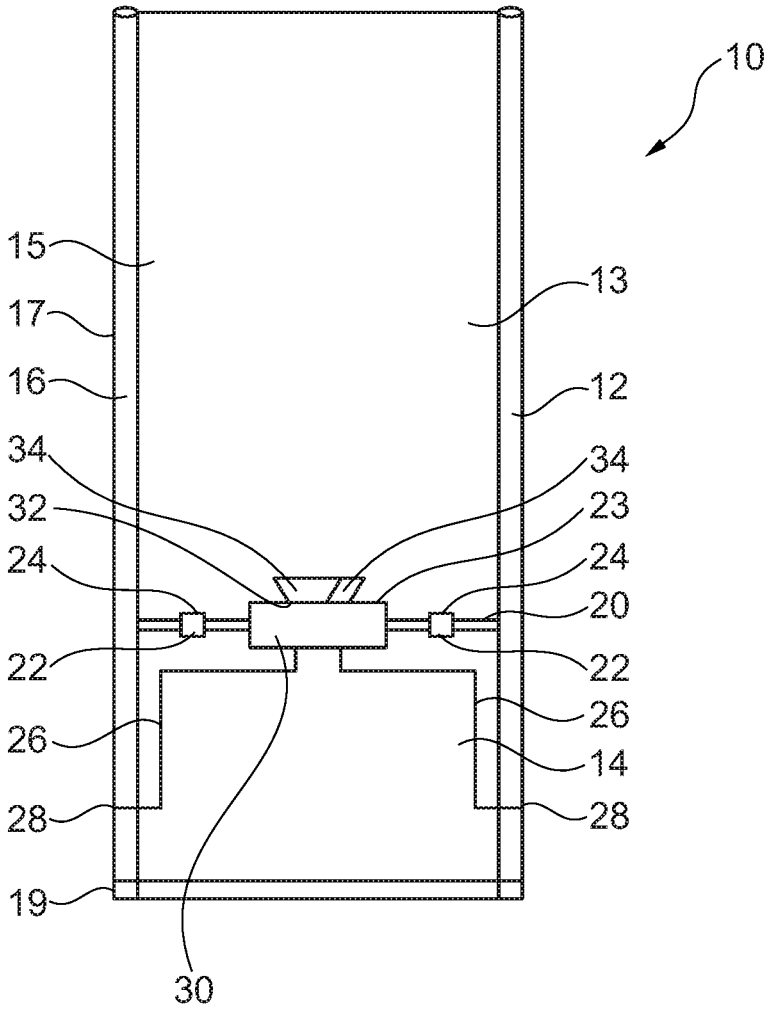

HANDLING DEVICE AND METHOD FOR GRIPPING AND INSERTING A PILE TUBE INTO A BOREHOLE

The invention relates to a handling device for gripping and inserting a pile tube into a hole in the ground to form a foundation pile, comprising a base frame, a gripping device for gripping and holding the pile tube, and a holding element for releasably connecting the base frame to a hoist, in particular a suspension rope, according to the preamble of claim 1.

The invention further relates to a method of gripping and inserting a pile tube into a hole in the ground, according to the preamble of claim 12.

EP 2 930 275 A1 discloses a method and an arrangement for the production of a foundation pile for a structure in water. In this method, a borehole with a support tube is first created in the ground. The borehole thus created is filled with a liquid, in particular water. A pile tube is inserted into the cased borehole thus created, for which a simple steel tube with a tubular base body is used. The outer support tube is then pulled out and the annular space between the inserted pile tube, which rests on the bottom of the borehole, and the surrounding borehole wall is filled with a curable medium. Surrounding water can remain within the pile tube. The bearing capacity of the foundation pile created in this way is determined by the outer shell surface of the inserted pile tube relative to the surrounding soil with the hardened medium in the surrounding annular space. The interior space, which is only filled with water, can be used for inserting measuring or testing equipment, for example, if required.

WO 2021/180515 A1 describes a device for handling and inserting a pile tube into a borehole. The device is configured to be attached to a suspension cable of a crane. By means of gripping elements, an annular edge of the pile tube can be gripped in a force-locking manner. Overall, the device is configured so that the pile tube can be pivoted from a horizontal storage position into a vertical insertion position.

US 2010/0296875 A1 discloses an arrangement and method for establishing an underwater foundation using an underwater drilling rig. The underwater drilling rig can be placed on the bottom of a body of water. A foundation borehole is created by means of tubular elements. The tubular elements may simultaneously serve to anchor the drilling device under water.

In known processes, after insertion of the pile tube into an established borehole, the outer annular space between the circumferential surface of the pile tube and the surrounding borehole wall is filled. For this purpose, it is known to introduce one or more feed hoses into the annular space, via which a curable medium, such as mortar or a cement slurry, is then introduced into the annular space. The curable medium should be introduced in such a way, if possible, that the annular space is filled from below so that liquid, in particular water, being in the annular space is displaced upwards from below by the curable medium.

Feeding the hose into the annular space is usually done manually from outside the borehole. With borehole depths of 10 meters and more, there is the problem that a feed hose can get caught in a central area of the borehole and thus not reach the bottom of the borehole. This is usually not detectable from outside the borehole. If the curable slurry is fed in with such an incorrectly inserted feed hose, fluid can remain in the annular space below the feed hose and get trapped by overlying curable slurry. In such a case, a pile tube would not be connected to the surrounding soil over the entire length after the slurry has cured. This reduces the load-bearing capacity of a correspondingly formed foundation element, so that a reliable foundation is no longer ensured.

Reworking of the foundation element may become necessary, which can be very time-consuming and costly. If so, it may even be necessary to rebuild the foundation element.

It is further known to provide a feed line for a curable slurry also inside the pile tube. Via the at least one feed line, curable medium can then be fed inside the pile tube up to the lower region of the pile tube and introduced via corresponding passages into the annular space outside the pile tube. In this method, a corresponding feed for the curable slurry must be arranged after the pile tube has been inserted either up to the passage into the annular space in the pile tube or to an upper connection on the pile tube. The production of a corresponding connection is time-consuming and labor-intensive and also involves the risk of errors.

It is the object of the invention to provide a handling device and a method by means of which a pile tube can be efficiently inserted into a hole in the ground to form a foundation element.

This object is achieved by a handling device having the features of claim 1 and a method having the features of claim 12. Preferred embodiments of the invention are specified in the dependent claims.

The handling device according to the invention is characterized in that at least one inlet device for supplying a curable medium is arranged on the base frame in an upper region and at least one outlet device for the curable medium to the pile tube is arranged in a lower region.

A basic idea of the invention is to use the handling device not only for gripping and inserting the pile tube into the borehole, but also for introducing the curable medium into the borehole. In particular, the handling device is not released from the pile tube after insertion of the pile tube into the borehole, but can remain in a defined initial position on the pile tube, which position was assumed by the handling device outside the borehole when gripping the pile tube. The relative position between the pile tube and the handling device specified in this way allows the curable medium to be reliably fed via the handling device.

For this purpose, the handling device comprises at least one inlet device on the base frame in an upper region for supplying a curable medium and at least one outlet device for the curable medium towards the pile tube in a lower region. The outlet device can be connected to a corresponding feed device on the pile tube.

A preferred embodiment of the invention is that the gripping device comprises a plurality of gripping elements for form-fit and/or non-form-fit holding of the pile tube. In this case, the gripping device serves to detachably connect the handling device to the pile tube. The connection can thereby be established in any suitable manner, in particular solely by or in conjunction with a non-form-fit clamping of the pile tube. For this purpose, for example, tightening or clamping devices, in particular collets, can be provided.

According to a further development of the invention, it is preferred that the gripping device is configured for form-fit and/or non-form-fit holding of the pile tube on its inner side. The gripping device can therefore grip and hold the pile tube on its inner side alone, in particular clamping it in a force-fit manner. Preferably, in this case, the handling device can be configured such that it is located within the outer circumference of the pile tube and does not protrude beyond an outer diameter of the pile tube. Thus, the handling device may be located wholly or partially within the pile tube. The pile tube can thus be inserted into a borehole with only an insignificantly larger borehole diameter and thus a correspondingly small annular space between the outer circumference of the pile tube and the surrounding borehole wall. In this way, consumption of curable medium, in particular mortar or a cement slurry, can preferably be kept to a minimum.

According to an embodiment of the invention, a particularly reliable holding of the pile tube can be achieved in that the gripping device comprises at least one adjusting cylinder, by means of which at least one gripping element can be adjusted between a holding position for holding the pile tube and a release position, in which the at least one gripping element is released from the pile tube.

The adjusting cylinder can be configured in particular as a hydraulic cylinder or a pneumatic cylinder. The actuating movement of the adjusting cylinder, which is preferably arranged in the longitudinal direction of the handling device and the pile tube, can be transmitted to one or more gripping or holding elements, in particular via a lever mechanism.

To supply the curable medium, it is further preferred that the inlet device comprises a connection device for connecting a supply line. The supply line can be a so-called umbilical, which can be configured to supply the curable medium, energy, in particular electrical, hydraulic and/or pneumatic energy, further fluids, such as a rinsing liquid and/or air, and/or data. The connection device can be configured in particular in the form of a plug-in connection or in another suitable manner.

For use under water, it can also be particularly advantageous for the connection device to include a quick-release device to ensure quick release in certain emergency or hazardous situations, such as in heavy seas, in order to prevent uncontrolled tearing off of the supply line.

According to a further embodiment of the invention, it is advantageous that the outlet device comprises at least one outlet for connection to a feed opening on a pile tube. Between the inlet device and the outlet device, one or more conveying lines may extend along the handling device. The outlet device may also be configured to engage a corresponding feed means on the pile tube to ensure reliable transfer of the curable medium from the outlet device to the feed opening on the pile tube. Preferably, one or more inlet funnels may be arranged at the feed device on the pile tube, into which one or more outlet tubes of the outlet device, for example, may extend.

According to one embodiment of the invention, it is preferred that an attachment element for placing the handling device on the pile tube is arranged in the borehole for particularly good positional security of the handling device on the pile tube. It should be emphasized that the handling device is connected to the pile tube in particular before the pile tube is inserted into the borehole. This allows a reliable and controlled connection between the handling device and the pile tube. The handling device can be placed or arranged at an upper edge of the pile tube and/or also in an inner area of the pile tube at a suitable position.

According to a further development, a particularly efficient operation of the handling device can be achieved by arranging at least one adjusting device by means of which the attachment element with the pile tube is displaceable and adjustable relative to a surrounding wall of the borehole, a support tube and/or a base frame of the handling device. Thus, the handling device can also be used for a certain subsequent adjustment of the pile tube relative to the surrounding wall of the bore. This may further increase the quality of the foundation element to be formed.

The adjustment device can basically be configured with a suitable actuator for adjustment and calibration. According to one embodiment of the invention, it is particularly advantageous that the adjusting device comprises at least one adjusting cylinder, in particular a hydraulic cylinder.

In particular, the handling device can be attached to a hoist, in particular a suspension rope or a suspension rod on a crane. In this case, it is advantageous that the holding element comprises an eyelet or a hook. A detachable connection can be established in a particularly simple and reliable manner, in particular with a crane hook or another conventional connecting element on a suspension cable or a suspension rod.

For a particularly durable use of the handling device, it is advantageous according to an embodiment of the invention that two conveying lines extend between the inlet device and the outlet device, which can be switched by means of a valve device in such a way that they can be connected in parallel to form a double feed line or can be connected in series for a flushing operation. In the case of a parallel connection, the curable medium can be fed in the same direction via the at least two conveying lines. By actuating the valve device, the two conveying lines can be connected in series so that a first conveying line can serve as a supplying line for a rinsing liquid and the second conveying line connected in series can serve as a return line for the rinsing liquid. Thus, with this arrangement, the two conveying lines can be reliably flushed free of the curable medium so that they do not become clogged and can thus be used several times.

The invention furthermore relates to a method for gripping and inserting a pile tube into a hole in the ground, wherein a handling device according to the invention described above is used. In this method, the previously described advantages in the use of a handling device can thus be achieved.

According to an embodiment of the method according to the invention, it is preferred that a curable medium is supplied to the pile tube via the handling device while the pile tube is held by the handling device. Hereby, curable medium can be supplied to the pile tube from the outside in a particularly reliable manner and, in particular, be introduced into a surrounding annular space around the pile tube. In this way, a foundation element of high quality can be produced without excessive consumption of curable medium.

According to a further development of the invention, it is preferred that the handling device is arranged with an attachment element on the pile tube and that with at least one adjustment device the base frame with the gripping device and the pile tube held therewith is displaced and adjusted relative to a support tube or the borehole. This allows an exact alignment of the pile tube within the borehole by means of the handling device.

According to the invention, another advantageous method variant is that the handling device on the pile tube is detached from the hoist and/or a supply line after insertion into the borehole and can remain on the pile tube as a ballast. The handling device continues to be attached to the pile tube and thus can remain attached to the pile tube as an additional ballast to hold the pile tube in place, at least until the curable medium introduced into the annular space around the pile tube has sufficiently cured and solidified. The handling device can then be detached from the pile tube again by the hoist, and be recovered.

Figure 2:
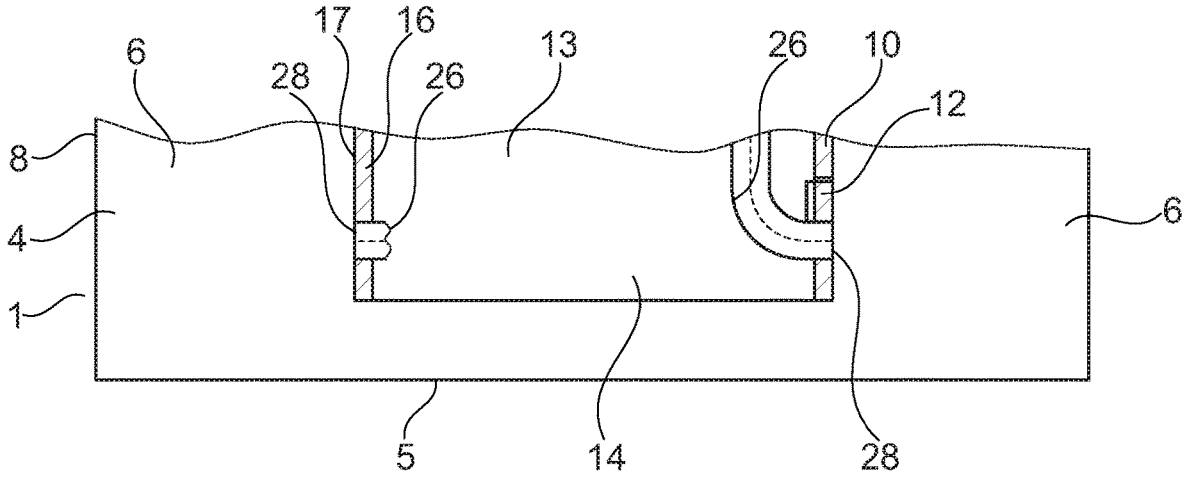
Figure 3:
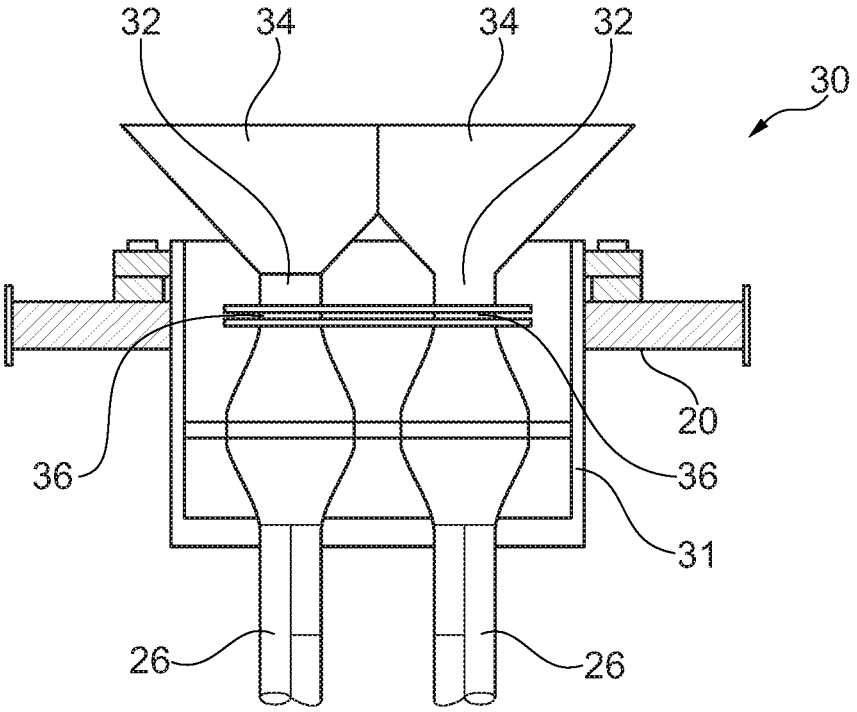
Figure 4:
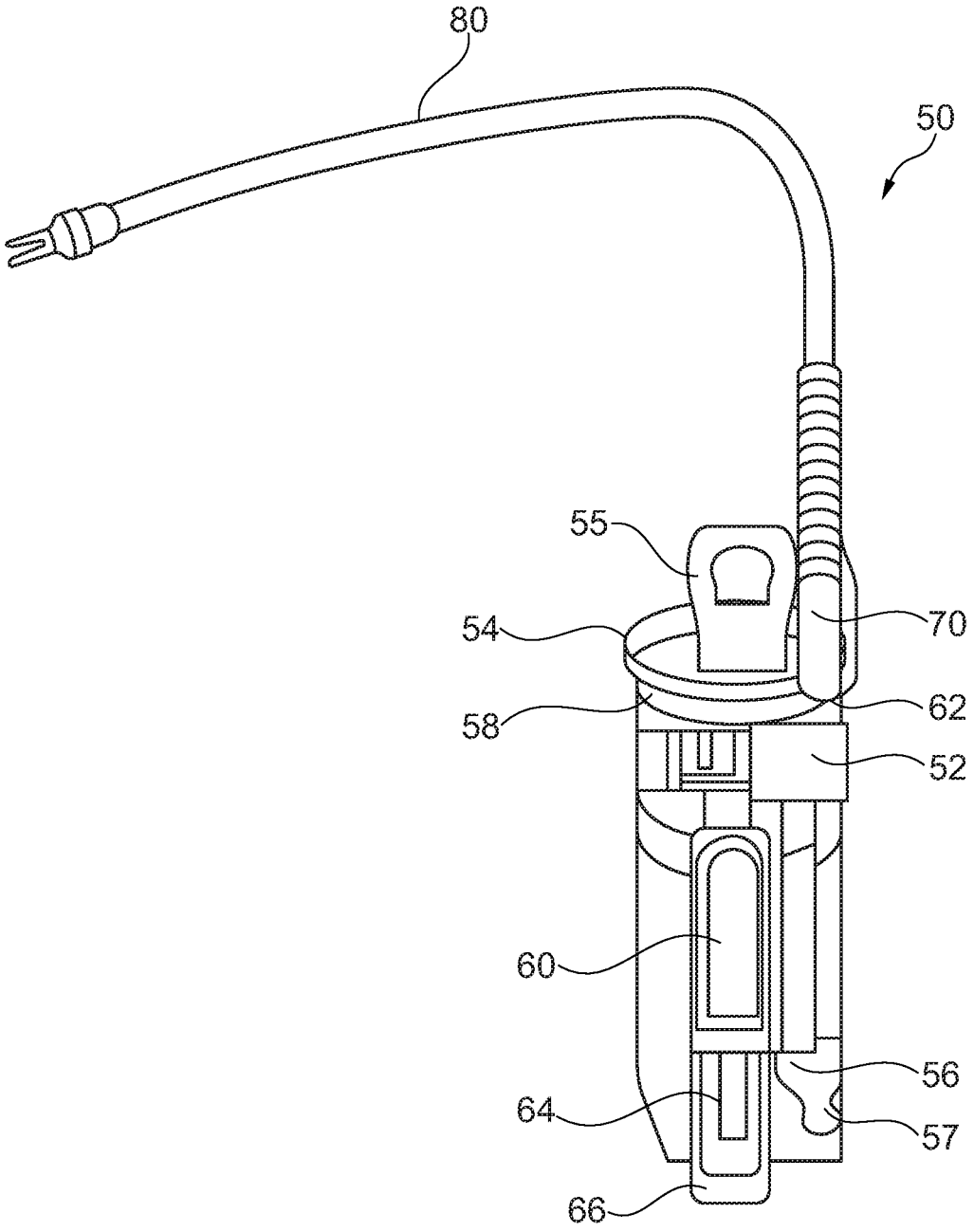

The invention is further explained below with reference to preferred examples of embodiments, which are shown schematically in the drawings. The drawings show in:

FIG. 1 a schematic sectional view of a pile tube with a bulkhead plate;

FIG. 2 a schematic representation of a lower part of a pile tube in a bore;

FIG. 3 a schematic detail cross-sectional view to a feed device on the bulkhead plate of a pile tube; and FIG. 4 a perspective view of a handling device for handling a pile tube.

According to FIG. 1, a pile tube 10 is provided with a tubular base body 12. In an inner region 13 of the tubular base body 12, a bulkhead plate 20 directed transversely to the longitudinal axis of the tubular base body 12 is arranged, which divides the inner region 13 into a lower section 14 and an upper section 15 and separates them from each other. An annular sealing element 19 may be arranged at a lower edge of the tubular base body 12, by means of which the pile tube 10 can be placed on a borehole bottom in a manner as sealing as possible.

In the illustrated embodiment, the bulkhead plate 20 comprises two schematically indicated through-openings 22, which can be selectively opened or closed by means of a likewise schematically indicated closing device 24. A feed device 30 with two schematically indicated feed openings 32, each with an insertion funnel 34, is arranged in a central region of the bulkhead plate 20, as will be described in more detail below in connection with FIG. 3.

The feed openings 32 with the insertion funnels 34 serve to feed a curable medium, in particular mortar or cement slurry, whereby the curable medium can be conducted below the bulkhead plate 20 via lines 26 up to a lower end region of the tubular base body 12. The conduits 26 thereby extend through a tubular wall 16 of the base body 12 and each terminate at the outer circumference 17 of the base body 12 in an outlet opening 28. Thus, curable medium can be conducted via an inner region 13 of the pile tube 10 up to a lower end region and can exit via the outlet openings 28 to the outside of the pile tube 10, as explained in more detail below in connection with FIG. 2.

In FIG. 2, a lower end region of a pile tube 10 according to the invention is shown which is inserted into a borehole 4 in the ground 1. Only the lower portion of the borehole 4 is shown, and the borehole 4 may have a depth of several meters, typically between 5 m to 30 m. The borehole 4 is filled with a fluid, in particular water or other supporting fluid, for support, so that the borehole 4 does not collapse even at greater borehole depths. A support tube may also be provided at least in some areas.

The pile tube 10 with a bulkhead plate 20 can be easily inserted into a borehole 4 filled with fluid in this way, if the through openings 22 on the bulkhead plate 20 are opened by the closing devices 24. After the pile tube 10 has reached a final position, in particular when the pile tube 10 is placed on a bottom hole 5 of the borehole 4, the through openings 22 can be closed again by the closing devices 24. Curing medium can now be introduced into the borehole 4 via the conduits 26, the curing medium being supplied within the pile tube 10 in the lower region by the conduits 26 and passing through the tube wall 16 at the lower end region and being able to exit into an annular space 6 via the outlet opening 28. The annular space 6 is formed between an outer periphery 17 of the tubular base body 12 and a substantially cylindrical wall 8 of the borehole 4. The curable medium can thereby fill the annular space 6 from bottom to top due to a higher density compared to the liquid in the borehole 4. Liquid is displaced upwards from the annular space 6 by the curable medium.

Due to the provided bulkhead plate 20, a lower section 14 of the inner area 13 of the pile tube 10 is sealed upwardly when the passage openings 22 are closed. Thus, the liquid in the lower section 14 of the pile tube 10 cannot be displaced upwards, so that no or hardly any curable medium can penetrate into the inner area 13 of the pile tube 10. In this way, the inner area 13 can be reliably kept free and curable medium or slurry can be saved.

Referring to FIG. 3, the feed device 30 of the pile tube 10 according to FIG. 1 is shown in more detail. The feed device 30 may comprise a pot-shaped receptacle 31, which is mounted in a central region of the bulkhead plate 20. In the pot-shaped receptacle 31, the feed openings 32 for the conduits 26 leading away downwardly are formed. For introducing the curable medium, the feed openings 32 comprise introduction funnels 34 at their upper region. The feed openings 32 can furthermore be formed with check valves 36, shown only schematically, which prevent an undesired backflow of the curable medium from the lines 26 in the example shown.

According to the invention, a handling device 50 as shown in FIG. 4 can be used to supply the curable medium. The handling device 50 comprises a base body 52 with a cover plate 54, on which an attachment element 58 is arranged for placing or arranging the handling device 50 on or on a pile tube 10.

Via a gripping device 56, which can alternatively or additionally also be configured as a non-form-fit clamping device, the handling device 50 can be detachably attached to an inner side of the pile tube 10 with at least one clamping or gripping element 57 in the illustrated embodiment. Preferably, a plurality of gripping elements 57 are arranged along the circumference of the approximately tubular or barrel-shaped base body 52.

The handling device 50 can be used to grip a pile tube 10 from a pile tube storage while it is still on a ground surface or a watercraft. The handling device 50 can be connected to a hoist, in particular a crane, via a holding element 55 at the upper end region of the base body 52. Thus, a pile tube 10 can be inserted from a storage position into a borehole 4 in the ground 1 via the handling device 50.

In addition, the handling device 50 is provided with a feed device 60, indicated only schematically, which in the illustrated embodiment comprises conveying lines 64 extending from an inlet device 62 at the upper end of the base body 52 up to a lower outlet device 66. The outlet device 66 is configured to engage over the inlet funnels 34 of the feed device 30 on a pile tube 10, as shown in FIG. 3, for the supply of a curable medium. Furthermore, a corresponding coupling unit may be provided on the handling device 50 to ensure accurate positioning and positional retention in cooperation with the coupling element 23 on the feed device 30 of the pile tube 10.

A supply line 80, which may also be referred to as an umbilical, may be used to supply curable medium, energy and/or data via a releasable connection device 70, whereby the curable medium is transferred to the inlet device 62 at the upper end region of the base body 52.

After the annular space 6 has been filled by the curable medium, the connecting line 80 and/or the hoist may be detached from the holding element 55, leaving the handling device 50 attached to the pile tube 10 as an additional superimposed load, at least until the curable medium for forming the foundation element in the ground 1 has cured. Thereafter, the handling device 50 may be released from the pile tube 10 again and retrieved.

The invention claimed is:

1. A handling device for gripping and inserting a pile tube into a borehole in the ground for forming a foundation pile, comprising a base frame, a gripping device for gripping and holding the pile tube, and a holding element for releasably connecting the base frame to a hoist, in particular a suspension rope, wherein in an upper region at least one inlet device for supplying a curable medium and, in a lower region, at least one outlet device for the curable medium to the pile tube are arranged on the base frame, and the inlet device comprises a connection device for connecting a supply line for supplying the curable medium.

2. The handling device according to claim 1, wherein the gripping device comprises a plurality of gripping elements for holding the pile tube in a form-fitting and/or force-fitting manner.

3. The handling device according to claim 1, wherein the gripping device is configured for form-fit and/or non-form-fit holding of the pile tube on its inner side.

4. The handling device according claim 1, wherein the gripping device comprises at least one adjusting cylinder by means of which at least one gripping element is adjustable between a holding position for holding the pile tube and a release position, in which the at least one gripping element is released from the pile tube.

5. The handling device according to claim 1, wherein the outlet device comprises at least one outlet for connection to a feed opening on a pile tube.

6. The handling device according to claim 1, wherein an attachment element for attaching the handling device to the pile tube is arranged in the borehole.

7. The handling device according to claim 6, wherein at least one adjusting device is arranged, by means of which the attachment element with the pile tube is displaceable and adjustable relative to a surrounding wall of the borehole or a support tube.

8. The handling device according to claim 7, wherein the adjusting device comprises at least one adjusting cylinder, in particular a hydraulic cylinder.

9. The handling device according to claim 1, wherein the holding element comprises an eyelet or a hook.

10. The handling device according to claim 1, wherein two conveying lines extend between the inlet device and the outlet device, which are switchable by means of a valve device in such a way that they can be connected in parallel to form a double feed line or can be connected in series for a flushing operation.

11. A method of gripping and inserting a pile tube into a borehole in the ground, wherein a handling device according to claim 1 is used.

12. The method according to claim 11, wherein a curable medium is supplied to the pile tube via the handling device while the pile tube is held by the handling device.

13. The method according to claim 11, wherein the handling device is arranged with an attachment element on the pile tube, and the base frame with the gripping device and the pile tube held thereby is displaced and adjusted relative to a support tube or the borehole by means of at least one adjusting device.

14. The method according to claim 11, wherein the handling device on the pile tube is released from the hoist and/or a supply line after insertion into the borehole and can remain as a superimposed load on the pile tube.

* * * * *